United States Patent [19]

Large

[11] 4,245,365

[45] Jan. 20, 1981

[54] FITTED TOP CONTOUR SHEET

[76] Inventor: Helen F. Large, 25 A Center St., Rumson, N.J. 07760

[21] Appl. No.: 94,326

[22] Filed: Nov. 14, 1979

[51] Int. Cl.[3] ..... A47G 9/02; A47G 9/04

[52] U.S. Cl. ..... 5/496; 5/497

[58] Field of Search ..... 5/495, 496, 497, 498, 5/485, 482

[56] References Cited

U.S. PATENT DOCUMENTS

| | | | |
|---|---|---|---|
| 2,757,389 | 8/1956 | King | 5/496 |
| 3,011,182 | 12/1961 | Burks | 5/484 |
| 3,654,646 | 4/1972 | McMahon, Jr. | 5/497 |

*Primary Examiner*—James T. McCall
*Assistant Examiner*—Alexander Grosz
*Attorney, Agent, or Firm*—LeBlanc, Nolan, Shur & Nies

[57] ABSTRACT

A fitted top contour sheet having an end pocket receiving the rear of a mattress and pairs of hooks and eyes to secure the bottom of the pocket to the mattress.

5 Claims, 4 Drawing Figures

FITTED TOP CONTOUR SHEET

BACKGROUND OF THE INVENTION

This invention relates generally to bedclothing and more specifically to a fitted top contour sheet of uncomplicated structure which is easily attached to and detached from the mattress with which it is used.

The prior patented art is replete with examples of contour, fitted bedclothing including bottom sheets, top sheets and blankets. Additionally, various means for attaching top sheets and blankets to the underlying mattress or bed are also disclosed in the prior patented art. For example, U.S. Pat. No. 2,757,389 issued to A. J. King discloses a fitted top contour sheet including an arcuate edged panel so that when the sheet is fitted onto a mattress, a foot pocket or space 32 is provided. Another example of a pocketed, fitted top sheet is illustrated in U.S. Pat. No. 2,151,375 issued to A. R. De Voe. A water bed including a mattress pad, bottom sheet and top sheet, all attached together by means of "Velcro" fasteners is disclosed in U.S. Pat. No. 4,040,133 issued to M. B. Gilreath. Other disclosures to "Velcro" fasteners for securing bedclothing to the bed are found in U.S. Pat. Nos. 3,066,321 and 3,066,323, both issued to M. M. Kintner. A hook and eye attachment for bedclothing to bed is shown in U.S. Pat. No. 3,011,182 issued to A. R. Burks while U.S. Pat. No. 3,179,958 discloses the use of bottons and cooperating bottonholes for securing the bedclothing. In U.S. Pat. No. 2,683,267 issued to C. Weil, a pair of ties are employed to secure a top blanket to the bedposts of a bed.

However, the prior art does not disclose a fitted top contour sheet readily formed from a single, rectangular sheet including a pocket structure adapted to fit beneath the foot of a bed mattress to thus provide a comfortable top sheet not requiring additional structure to provide foot space (such as disclosed at 32 in the King patent hereinbefore discussed). Nor is such a sheet disclosed including an uncomplicated hook and eye attachment for securing the sheet to the underlying mattress.

SUMMARY OF THE INVENTION

Accordingly, it is a principal object of the invention to provide a fitted top contour sheet of uncomplicated structure, readily made from a single, rectangular sheet, which includes a pocket to secure the sheet to an underlying mattress and is so formed to provide ample foot space for the user.

It is another object of the invention to provide a fitted top contour sheet having a rear pocket to secure the sheet to an underlying mattress, and including easily attached and detached hook and eye assemblies between mattress and sheet pocket so that the sheet may be easily removed for laundering, and the attaching assembly will not harm or tear other clothing, etc. that may be laundered with the sheet.

As disclosed herein, the fitted top contour sheet of the invention includes a top panel having length and width dimensions which are the same as the underlying mattress, side panels depending from the top panel, and a pocket formed at the rear of the sheet and arranged to engage the foot and part of the bottom of the underlying mattress. The pocket includes a rear, vertical panel, a horizontal bottom panel and side gusset members joining together adjacent side edges of the vertical and bottom panel. When the sheet is placed on the mattress, an angled opening from each side panel to the upper rear corner of the foot of the mattress provides sufficient "give" in the top panel so that a comfortable foot space is provided beneath the rear of the top panel for the user. A pair of hook and eye assemblies secure the bottom panel of the pocket to the mattress and are easily separated so that the sheet may be laundered.

BRIEF DESCRIPTION OF THE DRAWINGS

Further objects and advantages of the present invention will become readily apparent by reference to the following specification and drawings in which.

DESCRIPTION OF THE PREFERRED EMBODIMENTS

Figure 1:
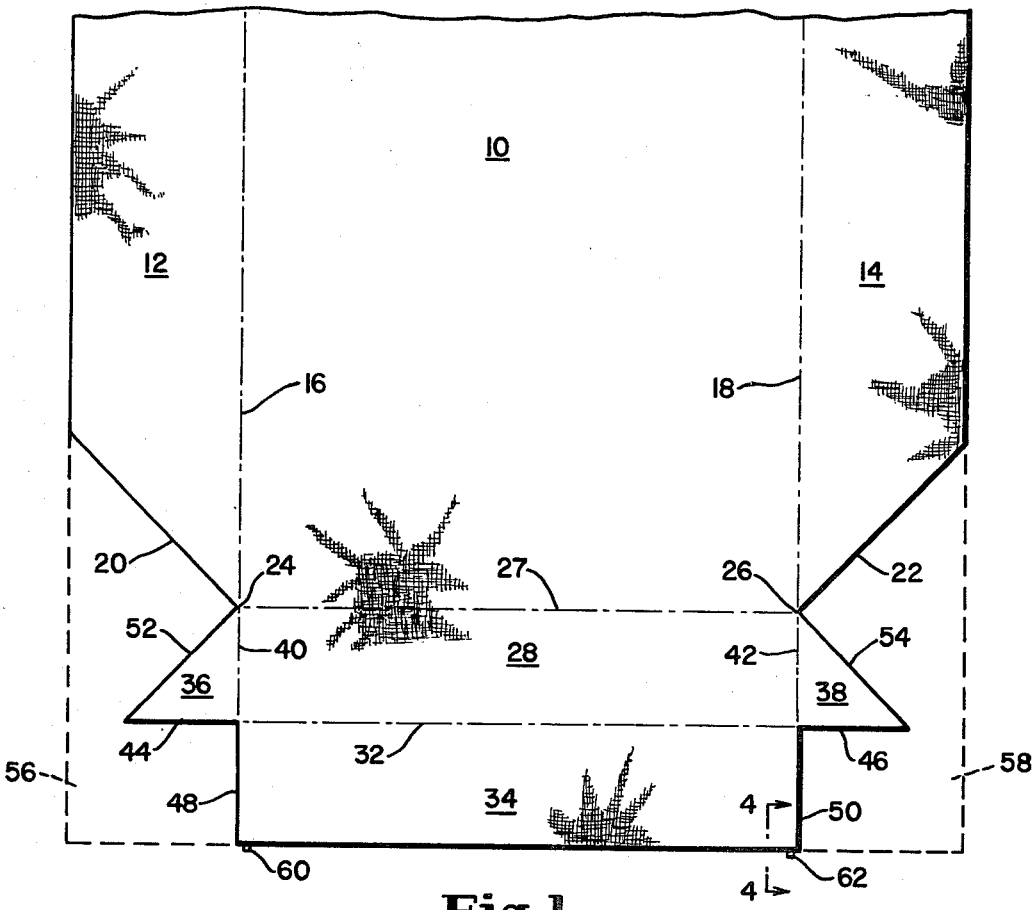
FIG. 1 is a top, partial plan view illustrating manufacture of a fitted top contour sheet in accordance with the principles of this invention.
Figure 2:
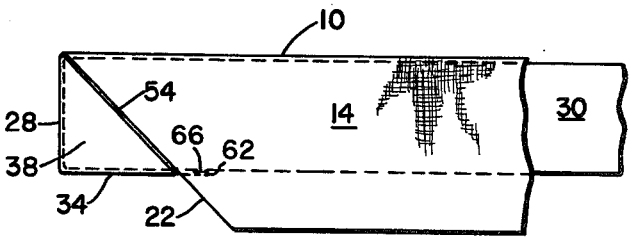
FIG. 2 is a partial, elevation view of the top sheet of FIG. 1 in place on a mattress.

Referring now to the drawings by reference character, FIG. 1 discloses the outline of a fitted top contour sheet made from a single piece of rectangular sheet material in accordance with the teachings of this invention. A central, top panel 10 is segregated from depending side panels 12 and 14 by fold lines 16 and 18. Each side panel 12, 14 has rear edges 20, 22, respectively, formed at an angle of about 45° , outwardly and forwardly from rear corners 24 and 26 to top panel 10. Another fold line 27 divides top panel 10 from a rear vertical panel 28 having a width dimension approximately the same as that of top panel 10 and a height dimension about the same as the thickness of an underlying mattress 30 (FIG. 2). Another lateral fold line 32 divides vertical panel 28 from a horizontal, bottom panel 34 which lies beneath the foot of mattress 30 when the completed sheet is placed on mattress 30.

When initially cut as shown in FIG. 1, vertical panel 28 has a trapezoidal configuration. Each end of panel 28 is further divided from a pair of gusset members 36 and 38 by vertical fold lines 40 and 42, respectively. Then, a base edge 44 and 46 of each gusset 36, 38 is sewn to its adjacent side edge 48, 50, respectively, or horizontal bottom panel 34 to thus form a pocket which engages the foot and a part of the bottom of mattress 30, as is clearly illustrated in FIG. 2. When the completed sheet is in place on mattress 30, open, angled edges 52, 54 of each respective gusset member 36, 38 lie essentially parallel to and adjacent edges 20, 22 of side panels 12, 14, respectively. Thus an opening is provided up to the upper rear corners of mattress 30 so that a user may place his feet comfortably beneath panel 10; there is sufficient give in the structure because side panels 12, 14 are not secured to the mattress. In usual practice, of course, they will not be tucked beneath mattress 30 when the bed is made. However, these cut openings just described eliminate the bulk of excess folds of sheeting having to be tucked in together with an overlying blanket (not shown), as when employing the "nurse's corner" style of making a bed.

After cutting of the material into the sheet illustrated in FIG. 1, portions 56, 58 may be discarded as surplusage.

A pair of hook members 60, 62 are sewn (as shown at 64, FIG. 4) or otherwise attached to the free corners of bottom panel 34. Mating eyes are secured to the bottom edges of mattress 30 one of which is illustrated at 66, FIG. 3, so that the sheet may be conveniently secured to mattress 30. Preferably, each eye 66 is made of simple fabric tape. Unlike prior art constructions, the hook eye assemblies are secured beneath the mattress so that they do not discomfort the user when the bed is slept in. As shown, the hook and eye assemblies are secured at edges of mattress 30 so thay may be readily detached when the sheet requires laundering. Additionally, it has been found that provision of only 2 small hooks 60, 62 allows the sheet to be laundered with other clothing without causing any damage to such other clothing.

Figure 3:
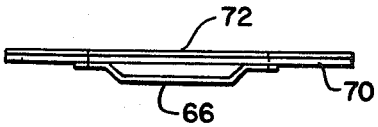
FIG. 3 is an elevation view of an eye member which may be attached to a mattress.
Figure 4:
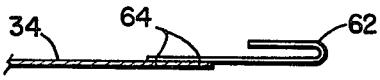
FIG. 4 is a view taken along lines 4—4 of FIG. 1, drawn to an enlarged scale and disclosing a hook employed with the eye of FIG. 3 to secure the sheet to a mattress.

FIG. 3 illustrates one embodiment of eye 66, the ends of which are attached by a suitable adhesive to a backing strip 70 of cardboard or plastic which may have a layer 72 of pressure sensitive adhesive on the rear thereof. A purchaser of a sheet made in accordance with this invention may simply remove an otherwise conventional backing strip (not shown) from layer 72 and then hand press each eye on to the lower edges of the mattress 30, after fitting the sheet onto the mattress to determine the correct location for each eye. The hooks and eyes may be secured where illustrated or, if desired, somewhat inwardly of the free corners of bottom panel 34 and, consequently, inwardly of the side edges of mattress 30, therebeneath (not shown). Pairs of eyes 66 may be secured to both sides of mattress 30 so that the sheet may be used as disclosed when the mattress 30 is reversed or turned over for even wear. Since each eye 66 is made of fabric tape, the user is not discomforted by the presence of the eyes 66 on top of the mattress. In retailing the invention, the manufacturer may include this extra pair of eyes for convenience of the consumer.

The disclosed invention thus provides a neat, quickly arranged top sheet having maximum foot room, which is more easily handled, washed and dried, and folded for storage and is light and more easily placed on a bed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fitted contour top sheet for use on a mattress comprising: a top panel having a front, a rear, and length and width dimensions approximately the same as the mattress with which the sheet is used, said top panel having opposed, rear corners; side panels along opposed sides of said top panel and terminating at the respective said corners, each said side panel having rear edges angled at about 45° from rear corner, forwardly to an outboard edge of said side panel; a pocket formed at the rear of said top panel comprising a vertical panel joined to said top panel, interconnecting said top panel rear corners, and having a height approximately the same as the thickness of the mattress with which the sheet is used, said vertical panel having a width generally equal the width of said top panel, a horizontal bottom panel having a width dimension generally the same as that of said vertical panel and having a rear elongate edge joined to said vertical panel at a lower, rear edge thereof, a pair of side, generally triangular gusset members joined to adjacent side edges of said vertical and horizontal bottom members to thereby form a pocket which is fitted over the foot and a part of the bottom of the mattress with which the sheet is used; and means on said horizontal bottom panel cooperating with means attachable to the mattress for releasably attaching said bottom panel to the mattress.

2. The fitted contour top sheet as claimed in claim 1 wherein said top panel, side panels, vertical panel and horizontal bottom panel are formed from a single sheet, said vertical member and gusset members forming a trapezoidal shaped panel in manufacture of said sheet prior to forming said pocket, the linear bases of said gussets being sewn to side edges of said bottom panel to thereby form said pocket.

3. The fitted contour top sheet as claimed in claim 1 wherein said cooperating means comprise a pair of hooks attached to opposed corners of said bottom panel remote from said gusset members, said means attachable to the mattress comprising a pair of eyes.

4. The fitted top contour sheet as claimed in claim 3 wherein each of said eyes further comprise a backing strip having pressure sensitive adhesive surface on a surface of said strip opposite said each eye.

5. The fitted top contour sheet as claimed in claim 3 wherein each of said eyes is made of flexible material.

* * * * *